US005676571A

United States Patent [19]

Matthews

[11] Patent Number: 5,676,571

[45] Date of Patent: Oct. 14, 1997

[54] SOCKET CONTACT WITH INTEGRALLY FORMED HOOD AND ARC-ARRESTING PORTION

[75] Inventor: Russell H. Matthews, Fremont, Calif.

[73] Assignee: Elcon Products International, Fremont, Calif.

[21] Appl. No.: 693,999

[22] Filed: Aug. 8, 1996

[51] Int. Cl.[6] ..... H01R 13/187

[52] U.S. Cl. ..... 439/843; 439/839

[58] Field of Search ..... 439/843, 851, 439/852, 856, 848, 183, 857, 839, 844

[56] References Cited

U.S. PATENT DOCUMENTS

| | | | |
|---|---|---|---|
| 2,427,001 | 9/1947 | Hubbell et al. | 439/844 |
| 2,658,183 | 11/1953 | Klostermann et al. | 339/64 |
| 3,120,989 | 2/1964 | Solorow et al. | 339/256 |
| 3,243,868 | 4/1966 | Anderson et al. | 439/843 |
| 3,486,163 | 12/1969 | De Vuyst et al. | 339/64 |
| 3,560,911 | 2/1971 | Zimmerman, Jr. et al. | 339/258 |
| 3,579,282 | 5/1971 | Couper | 439/848 |
| 3,697,933 | 10/1972 | Black et al. | 339/192 R |
| 3,945,699 | 3/1976 | Westrom | 339/12 R |
| 4,423,917 | 1/1984 | Scheingold et al. | 339/64 M |
| 4,451,107 | 5/1984 | Dola et al. | 339/143 R |
| 4,569,565 | 2/1986 | Golder | 339/64 R |
| 4,655,526 | 4/1987 | Shaffer | 439/851 |
| 4,749,357 | 6/1988 | Foley | 439/80 |
| 4,824,380 | 4/1989 | Matthews | 439/78 |
| 5,055,055 | 10/1991 | Bakker | 439/78 |
| 5,088,942 | 2/1992 | Welsh et al. | 439/843 |
| 5,106,329 | 4/1992 | Maeshima et al. | 439/851 |
| 5,431,576 | 7/1995 | Matthews | 439/247 |
| 5,468,164 | 11/1995 | Demissy | 439/843 |
| 5,588,852 | 12/1996 | Puerner | 439/851 |

FOREIGN PATENT DOCUMENTS

| | | | |
|---|---|---|---|
| 0401723 | 12/1990 | Germany | 439/851 |
| 0107481 | 4/1989 | Japan | 439/851 |

OTHER PUBLICATIONS

Partial translation of EP 0 401 723 (selected excerpts) which original was cited in PTO–892 as Germany 0401723, published Dec. 12, 1990.

*Primary Examiner*—Gary F. Paumen
*Assistant Examiner*—Tho D. Ta
*Attorney, Agent, or Firm*—Burns, Doane, Swecker & Mathis, L.L.P.

[57] ABSTRACT

A socket contact for mating with a pin contact in an electrical connector. The socket contact is provided with an electrical component-attaching section integrally formed with a receptacle section for providing an electrically efficient design. The receptacle section has a centrally disposed opening therein having an arc-arresting end portion with a diameter smaller than the diameter of the pin so that the end portion initially engages the pin and establishes an electrical connection between the pin and socket contacts. The socket contact is expandable so that the centrally disposed opening can enlarge to accommodate the pin passing therethrough into the bore.

12 Claims, 5 Drawing Sheets

SOCKET CONTACT WITH INTEGRALLY FORMED HOOD AND ARC-ARRESTING PORTION

BACKGROUND OF THE INVENTION

1. Field of the Invention

This invention relates to socket contacts for use in electrical connectors and more particularly to socket contacts with a structure for protecting against arcing between the related pin contact and the inner portion of the socket contact. Most especially, it relates to such a socket contact in which the inner portion to be protected against arcing is a thin foil conductive strip.

2. Description of the Prior Art

Socket contacts which are generally tubular in shape have been provided for use in electrical connectors. In general, the socket contact is connected to a voltage source and has an end with an opening to a bore therein which is designed to receive the protruding end of a related pin contact. Some socket contacts have an opening with a diameter greater than the diameter of the mating pin to allow entry of the pin therein. These socket contacts often include a thin foil conductive strip mounted inside, the strip having a raised portion which protrudes into the center of the receiving bore for engaging the contact pin. The strip serves to enhance the electrical connection between the pin and socket contacts.

When an electrical potential exists between the socket and pin contacts, arcing can occur between the contacts as they are brought close together for mating. Any arcing will cease once the socket and pin contacts make physical contact, at which time current passes between the contacts causing the electrical potential difference to dissipate. With socket contacts having conductive foil strips mounted therein and bore openings which permit passage of the contact pin without the pin contacting the end of the socket contact, arcing can occur between the conductive foil strip and the contact pin. Such arcing can melt or erode the conductive foil strip, causing damage thereto and thereby reducing the performance of the socket contact.

The conductive strip enhances the electrical connection between the pin and socket contacts but the socket contacts of the prior art introduce electrical inefficiency into the system by having a forward tubular section that is formed separately from a tail section thus introducing resistance into the path from the forward section to the tail section.

As can be seen from the foregoing, the socket contacts of the prior art which include thin conductive foil strips mounted therein are susceptible to deleterious electrical arcing and they introduce electrical inefficiency into the system.

SUMMARY OF THE INVENTION

The present invention provides a socket contact for use with a pin contact in an electrical connector. The socket contact of the present invention provides protection against electrical arcing damage to the thin foil conductive element that is inside the socket contact with a more electrically efficient design than is provided by the prior art.

The socket contact includes an electrical component-attaching end section integrally formed with a tubular receptacle section (i.e., there is no joint between the end section and the receptacle section; the two sections that form the socket contact are one continuous part). The receptacle section is provided with a central longitudinal axis, a bore extending along the axis formed from an inner surface which is generally circular in cross-section, and an arc-arresting end portion with a centrally disposed opening therein which extends into the bore. The opening in the arc-arresting end portion has a diameter smaller than the pin diameter so that the arc-arresting end portion initially engages the pin and establishes an electrical connection between the pin and socket contacts. The receptacle section further includes expansion means for permitting the opening in the end portion to expand and enlarge so as to let the pin pass therethrough into the bore.

A thin foil conductive element is located in the bore of the socket contact and has a contact portion raised thereabove for contacting the pin. The mandatory engagement and resulting electrical connection between the contact pin and the arc-arresting end portion of the socket contact precludes deleterious electrical arcing between the pin contact and the thin foil conductive element. The integrally joined receptacle section and electrical component-attaching end provide a more electrically efficient socket contact.

In one aspect there is provided a socket contact for mating with a pin contact. The socket contact having an electrical component-attaching section integrally formed with a receptacle section, the receptacle section forming a bore for receiving the pin contact, the receptacle section having a conductive element in the bore having a contact portion for contacting the pin contact, an arc-arresting end portion with an opening therein which opens into the bore and has a diameter smaller than an outer diameter of the pin contact for initially engaging the pin contact and establishing an electrical connection between the pin contact and the socket contact whereby the mandatory engagement and resulting electrical connection between the pin contact and the arc-arresting end portion precludes deleterious electrical arcing between the pin contact and the conductive element, and expansion means for permitting the opening to expand as the pin passes therethrough into the bore.

In another aspect there is provided an electrical socket contact for mating with a pin contact in an electrical connector. The socket contact having an electrical component-attaching end an elastically expandable cylindrical section opposite of and integral with the electrical component-attaching end, the elastically expandable cylindrical section having a cavity therethrough for receiving the pin contact and an opening with a diameter smaller than an outer diameter of the pin contact whereby when the pin contact is inserted through the opening into the cavity, an electrical connection is initially made between the pin contact and the cylindrical section in an area adjacent to the opening and a strip of spring contacts of conductive material located in the cavity of the elastically expandable cylindrical section.

BRIEF DESCRIPTION OF THE DRAWINGS

Many objects, advantages and features of the invention will be more readily apparent to those skilled in the art after review of the following detailed description of the invention, taken together with the drawings, in which.

DETAILED DESCRIPTION OF THE PREFERRED EMBODIMENTS

Figure 1:
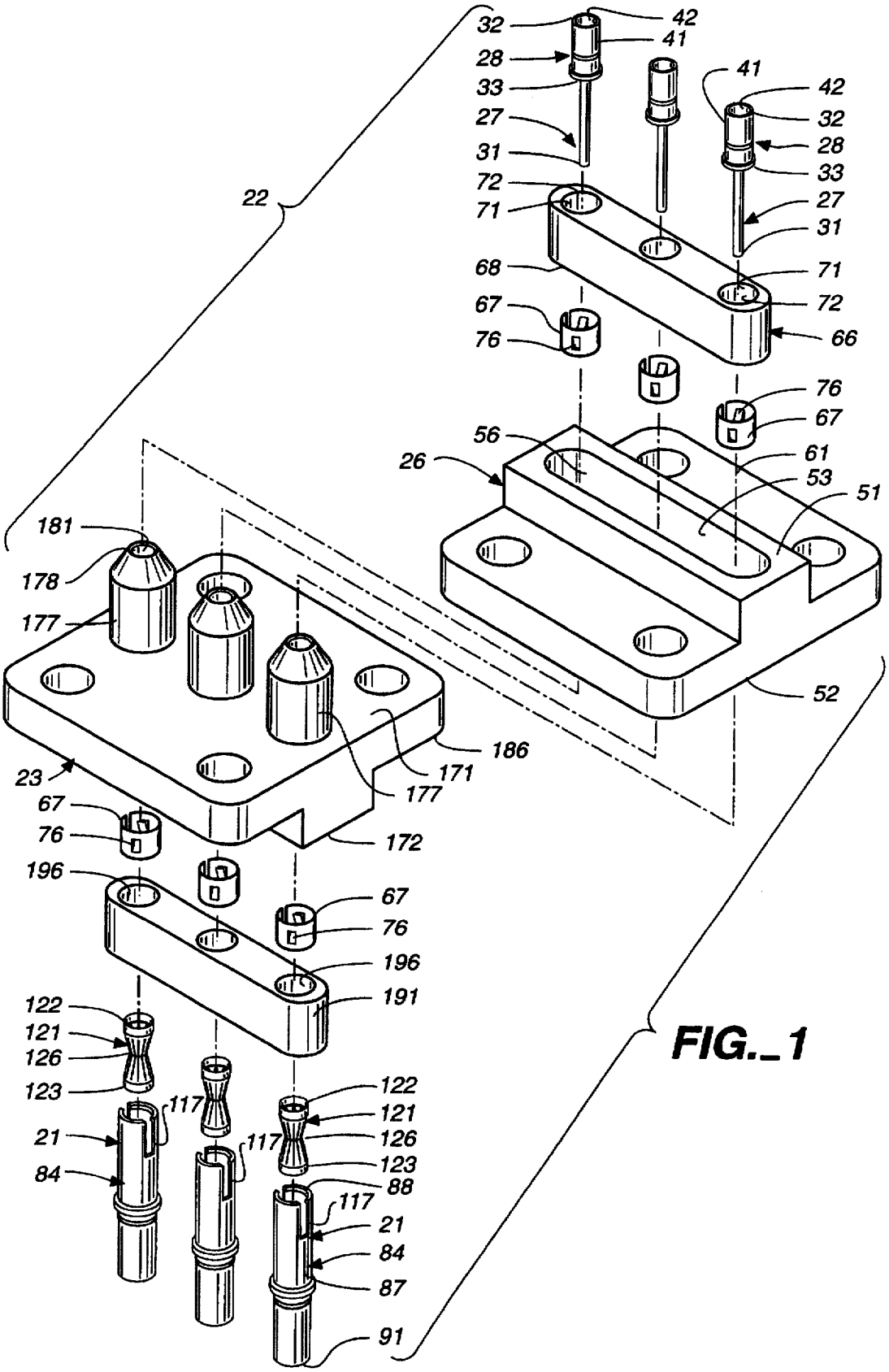
FIG. 1 is an isometric, exploded view of a male connector housing with its attendant pin contacts and a female connector housing with its attendant socket contacts in accordance with one embodiment of the present invention.

In general, a socket contact 21 of the present invention is for use in an electrical connector 22 having a housing formed from a suitable plastic such as polyester (FIG. 1). A suitable connector 22 has female and male mating housing portions or sections 23 and 26 which connect together. Socket contact 21 is carried by female housing section 23 and can be connected to a voltage source by electrical component-attaching end 158. A pin contact 27, designed to cooperatively mate with the socket contact, is carried by male housing section 26. Connector 22 shown in FIG. 1 has three socket and pin contacts 21 and 27, but for simplicity only one socket contact and pin contact are illustrated in detail in the remaining figures and discussed herein. Likewise, except for FIG. 5, the housing portions 23 and 26 have been removed from the figures for clarity and simplicity. It is noted that connectors 22 having other configurations and carrying various numbers of socket and pin contacts 21 and 27 are within the scope of the present invention.

Figure 5:
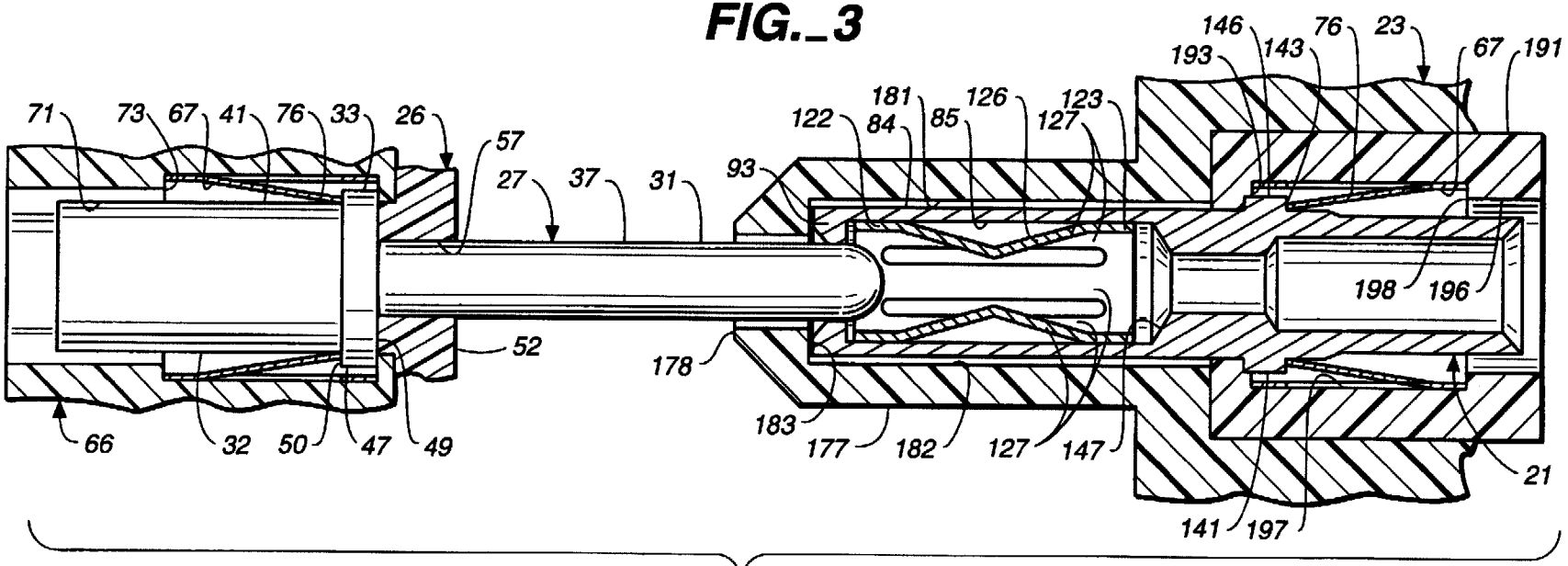
FIG. 5 is a partial sectional view of a pin contact being inserted into a socket contact in accordance with one embodiment of the present invention.

A typical pin contact 27 consists of a conductive body 28 made of a suitable conductive material such as copper or brass and having a circular cross-section. Conductive body 28 has an elongate slender contact pin 31 for mating with socket contact 21 and an opposite and axially aligned electrical component-attaching or shank portion 32 for relaying the electrical signal from a voltage source to the contact pin (FIGS. 1 and 5). Pin 31, serving as the distal end portion of pin contact 27, is generally circular in cross-section with a pin diameter indicated by dimension 36 in FIG. 5A. Pin 31 has an outer surface 37 and a rounded end 38 which serves as the first end of pin contact 27. Shank portion 32 has an outer surface 41 and an axially centered inner surface 42 which is generally circular in cross-section and forms a bore for receiving a conductive element (e.g., wire). Outer surfaces 37 and 41 are separated by collar 33 which forms a generally circular surface 47. The collar projects radially outwardly from pin contact 27 beyond outer surface 41. Collar 33 has a seating surface or shoulder 49 which is generally perpendicular to the pin outer surface 37.

Male connector housing section 26 has first and second sides 51 and 52 and is provided with an elongated cavity 53 formed by inner surface 56 opening onto first side 51 (FIG. 1). Cavity 53 includes three circular bores 57 (only one shown in FIG. 5) extending through the cavity 53 to second side 52. When pin contact 27 is mounted in male housing section 26, pin 31 extends through bore 57 and seating surface 49 of collar 33 is seated against male housing portion 26 (FIGS. 1 and 5). Each bore 57 is dimensioned to snugly accommodate the related pin 31. Male housing section 26 can also be provided with flanges 61 for securing the male housing section to female housing section 23.

Pin contact 27 is retained in male housing section 26 by an elongated locking element 66 and clip ring 67 (FIGS. 1 and 5). Locking element 66 is made from a suitable plastic such as polyester and is configured and dimensioned so that a portion snaps into and seats within cavity 53. Locking element 66 has a leading end 68 and is provided with three bores 71 extending therethrough and sized to accommodate shank portion 32 therewithin. Each bore 71 is formed by an inner surface 72 which is generally circular in cross-section and has an annular shoulder 73 formed therein for supporting a clip ring 67. Each clip ring 67 is formed from a generally circular metallic strip and has a plurality of inclined barbs 76 protruding radially inwardly toward one end thereof.

Male housing section 26 is assembled by mounting clip ring 67 in bore 71 and inserting pin contact 27 until the ends of barbs 76 are positioned against shoulder 50 of collar 33. Locking element 66, with pin contact 27 and clip ring 67 mounted therein, is then snapped into cavity 53 of male housing section 26 with pin 31 protruding through bore 57.

Socket contact 21 (FIG. 2) is an integrally formed socket body having a receptacle section or hood 84 adapted to receive pin 31 and an electrical component-attaching end portion 158. Receptacle section or hood 84 is generally cylindrical, with a central bore 85 extending therethrough, and is axially centered on a longitudinal axis 86 of the socket contact 21. Socket contact 21 is preferably made of a suitable conductive material such as tellurium copper alloy C14500 per ASTM B 301 gold plated per MIL-G-45204 over nickel per QQ-N-290. Tellurium copper alloy is preferred over other acceptable conductive materials because of its 100% conductivity. Hood 84 comprises an arc-arresting end portion or contact portion 93, an end portion 96 opposite the arc-arresting portion, and a central portion 97 therebetween. Central portion 97 has an inner surface 101 which forms the central portion of bore 85. Surface 101 is generally circular and is coaxial about axis 86 with outer surface 87 of receptacle portion 84. End portion 96 has an inner surface 116 which is generally circular in cross-section and forms a portion of bore 85. Surface 116 is coaxial about axis 86 with central portion inner surface 101 having an approximately equivalent radial dimension therewith.

Arc-arresting portion 93 has a opening 111 having an inner surface 103, which is generally circular with a diameter indicated by dimension 106 (FIG. 5A), adjoined to bevelled or tapered surface 100 at the radially inner end thereof. More specifically, bevelled surface 100 extends radially outwardly from surface 103 and intersects end surface 88. Surfaces 100 and 103 are coaxial with axis 86 and form opening 111 to bore 85. The arc-arresting portion 93, partially bounded by the wall 102 which joins inner surface 103 to surface 105, is relatively thick compared to the walls along the length of the hood 84 so as to accommodate "hot plugging". "Hot plugging" is the assembly of the pin contact 27 with the socket contact 21 while an electrical potential exists between the pin contact and the socket contact. This electrical potential can result in arcing between the socket contact and the pin contact as they are brought into close proximity. Such arcing can erode or melt thin pans causing damage thereto and reducing the performance of the socket contact. The heavier material thickness (i.e., robustness) of the arc-arresting portion 93 can accommodate the initial power surges with minimal or no damage to the arc-arresting portion on each hot plug connection during the anticipated life of the devise. In operation, as the pin contact 27 is moved into near contact with the socket contact, the initial arc is absorbed by the portion 93. In this way, the portion 93 precludes electrical arcing between the pin contact and the thin conductive element 121 thus eliminating damage to the thin foil conductive element.

Figure 3:
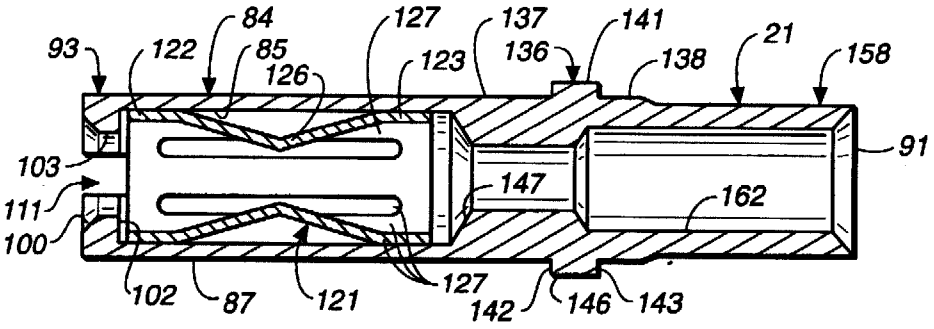
FIG. 3 is a sectional view of the socket body of FIG. 2 with a thin conductive element located therein.

Hood 84 includes expansion means for permitting opening 111 in contact portion 93 to expand radially outwardly to a larger diameter for permitting pin 31 to pass therethrough into bore 85. In one embodiment, the expansion means comprises one or more openings or longitudinal slots 117 in hood contact portion 93 and central portion 97. Slots 117 are spaced circumferentially about axis 86 at approximate equal angular intervals. The slots 117 in hood 84 produce tines in the hood. Two slots and two tines are shown in the figures but it is contemplated that any number of tines can be used. The slots are sufficiently long to allow the tines to move away from and toward each other and for opening 111 to expand and contract as the pin contact is inserted therein and removed therefrom multiple times without failing. A thin foil conductive element in the form of conductive strip or "crown" band 121 made from, for example, a heat-treatable grade beryllium-copper alloy gold plated per MIL-G-45204 over nickel per QQ-N-290 or any other suitable material (such as but not limited to tellurium copper alloy, phosphor-bronze, brass, stainless steel, etc.) is mounted substantially around inner surfaces 101, 105 and 116 of hood 84 (FIG. 3). Conductive foil strip 121 is generally tubular in shape and has a first end portion or engagement portion 122 adjacent annular surface 105 and an opposite second end portion or engagement portion 123. Engagement portions 122 and 123 serve as contacts with the socket body when conductive strip 121 is mounted within hood 84 and are each generally dimensioned to spring fit therein. Conductive strip 121 has a central contact portion 126 between and raised above engagement portions 122 and 123 for contacting pin 31. Preferably, conductive strip portion 126 is formed from a plurality of spaced apart foil cross members 127 which are longitudinally aligned with axis 86 for contacting pin 31. Each cross member 127 is joined at opposite ends to engagement portions 122 and 123 and, when viewed in longitudinal cross-section, has an arcuate shape which extends radially inwardly toward the center thereof. The use of a multiplicity of cross members is advantageous because the large number of contacts accommodate higher amperage connectors, improve electrical conductivity, create lower voltage drops, and lower the power consumption of the system.

Figure 2:
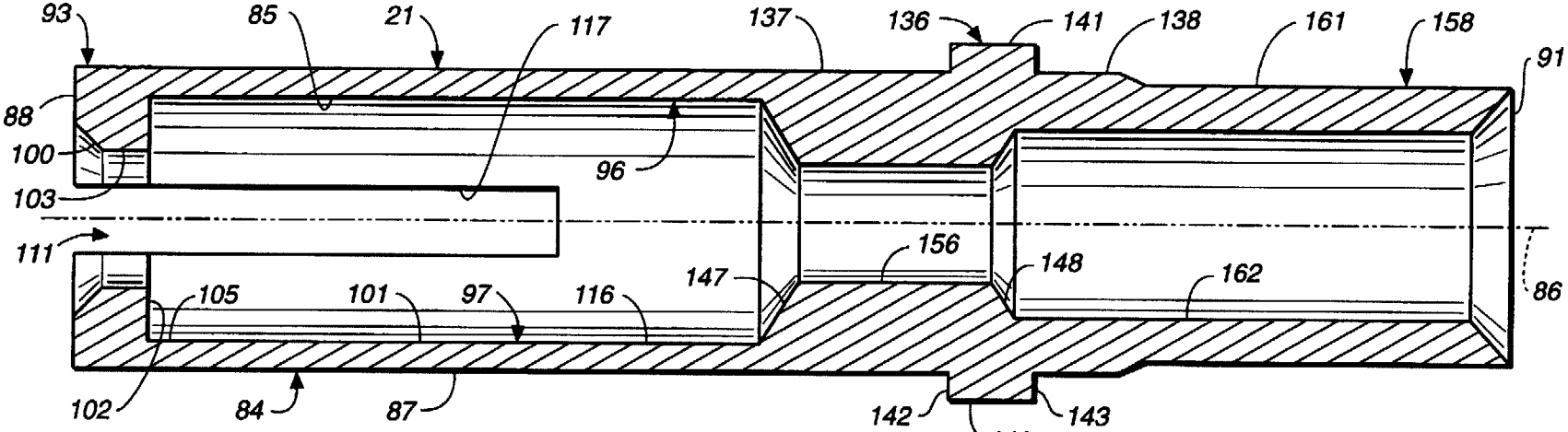
FIG. 2 is a sectional view of a socket body in accordance with one embodiment of the present invention.
Figure 4:
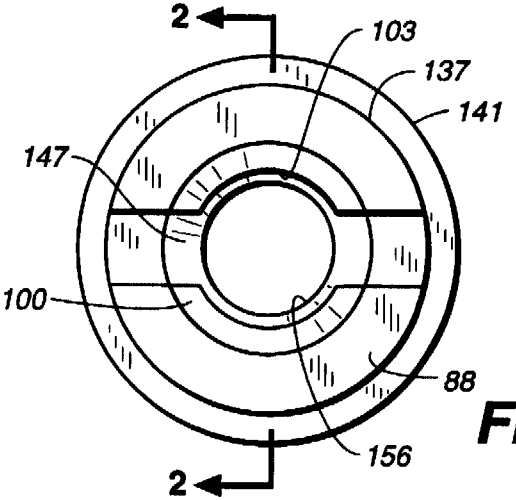
FIG. 4 is an end view of the socket body of FIG. 2 looking into the pin contact receiving end.

Socket contact 21 further includes a generally cylindrical middle section 136 which is integrally formed with hood 84. Middle section 136 is centered about axis 86 and has a first end portion 137, a second opposite end portion or shank portion 138 and a central portion with annular stop ring or collar 141 therebetween. Collar 141 is formed from first or seating and second or trailing spaced apart generally parallel surfaces 142 and 143 which extend radially outwardly from axis 86 and a generally circular outer surface 146 which interconnects surfaces 142 and 143 (FIG. 2). First end portion 137 is generally cylindrical with a first bore 156 which connects with bore 85 through tapered portion 147 of second end portion 96. Bore 156 is generally centered on axis 86 and ends by Connecting to tapered portion 148 leading to second bore 162. Shank portion 138 is integrally formed with middle section 136 and tapers to generally circular outer surface 161. End portion 158 is generally cylindrical with a second bore 162 which extends through electrical component-attaching end portion 158 to beveled opening 91. Second bore 162 is generally centered on axis 86 and is connected to first bore 156 by tapered portion 148.

First connector housing section 23 is similar in many respects to second connector housing section 26 and has first and second sides 171 and 172 (FIG. 1). Second side 172 is provided with an elongated cavity (not shown). Unlike second section 26, however, first side 171 of the first connector housing section 23 includes a receptacle, in the form of tubular casing 177, for housing each socket contact 21 used therewith (FIGS. 1 and 5). Each casing 177 includes a relatively planar outer end surface 178 which serves as a mating surface and is provided with a bore 181 which opens at one end on casing end surface 178 and extends into first housing connector section 23. Bore 181 is formed by a generally circular inner surface 182 and annular surface 183 which protrudes radially inwardly around the opening of the bore. As can be seen in FIG. 5, bore 181 has an inner diameter greater than the outer diameter of hood 84 so that the hood can expand as the pin 31 is inserted therein. First housing connector section 23 can also have a plurality of flanges 186 for securing it to second housing connector section 26 by bolting, clamping or otherwise interconnecting each flange 186 with a related flange 61 on second housing connector section 26. However, the housing connectors do not have to be bolted or clamped together to remain connected.

Socket contact 21 is retained in first connector housing section 23 by an elongated locking element 191 and clip ring 192 substantially similar to locking element 66 and clip ring 67 (FIGS. 1 and 5). Locking element 191 is configured and dimensioned so that a portion snaps within the elongated cavity in second side 172 previously described but not shown. Locking element 191 is provided with bores 196 therethrough. Each bore 196 is adapted to accommodate end portion 158 and is formed by a generally circular inner surface 197 having an annular shoulder 198. Clip ring 67 has a plurality of barbs 76 thereon which protrude radially inwardly toward one end thereof, and is supported in locking element 191 by annular shoulders 198 and 193.

Female housing section 23 is assembled by mounting clip ring 67 in bore 196 and inserting socket contact 21 therethrough until the ends of barbs 76 are positioned against trailing surface 143 of collar 141. End portion 158 is disposed in bore 196 of locking element 191 with one end supported by annular shoulder 193. Locking element 191, with socket contact 21 and clip ring 67 mounted therein, is then snapped into the elongated cavity of female housing section 23 with hood 84 extending into bore 181 of casing 177.

Housing sections 23 and 26 can be interconnected with each pin 31 protruding from male housing section second side 52 slidably received by a hood 84 of the corresponding socket contact 21 housed in casing 177 within female housing section 23.

Figure 5A:
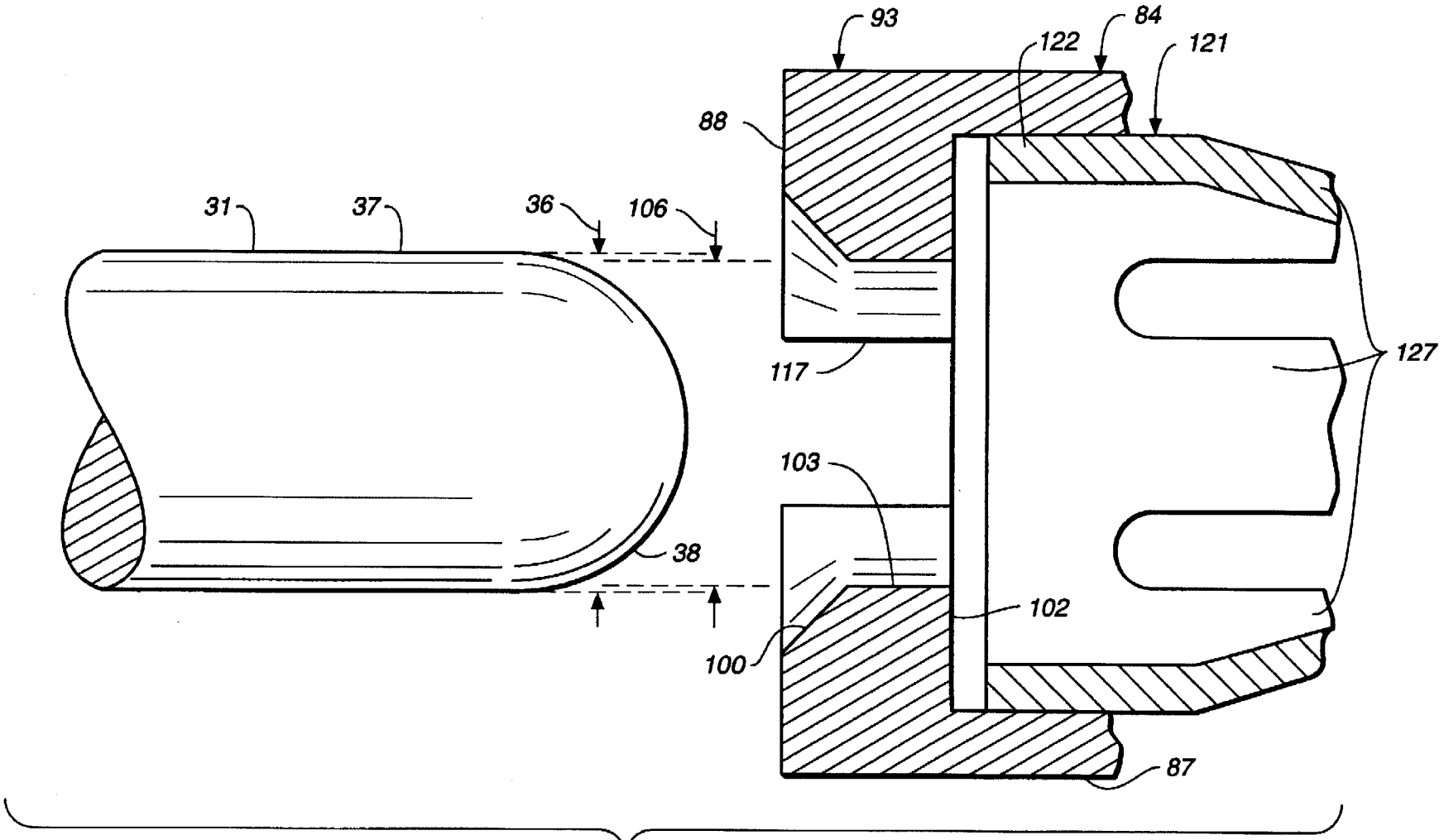
FIG. 5A is an enlarged partial sectional view of a pin contact just prior to contact with the arc-arresting end portion in accordance with the present invention.
Figure 6:
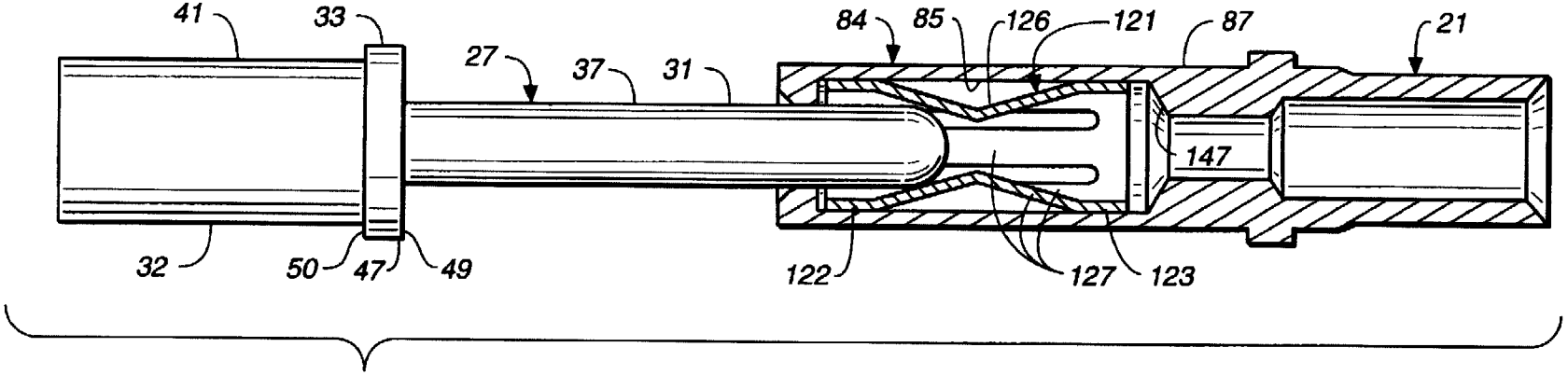
FIG. 6 is a partial sectional view of the pin contact partially inserted in the socket contact.

Bore opening 111 formed by inner surface 103 of hood 84 has a diameter 106 which is smaller than diameter 36 of pin 31 (FIG. 5A). As a result, pin 31 cannot enter bore 85 and opening 111 without first engaging bevelled surface 100 of arc-arresting end portion 93 and pin 31 cannot contact conductive element 121 without first engaging bevelled surface 100, thereby establishing an electrical connection between the socket and pin contacts 21 and 27. The mandatory engagement and resulting electrical connection between the pin 31 and the arc-arresting end portion 93 when an electrical potential exists between the pin contact 27 and socket contact 21 precludes deleterious electrical arcing between the pin 31 and the conductive element 121. Once pin 31 has made physical and electrical contact with bevelled surface 100, pin contact 27 must be forcibly further mated with hood 84 for pin 31 to further enter central bore 85 to make contact with conductive element 121. The rounded configuration of pin end 38 and the conical configuration of surface 100 urge hood 84 to radially expand and enlarge as the pin is so inserted therein (FIG. 6). Longitudinal slots 177 in hood contact and central portions 93 and 97 permit this expansion so as to accommodate pin 31 passing therethrough.

Figure 7:
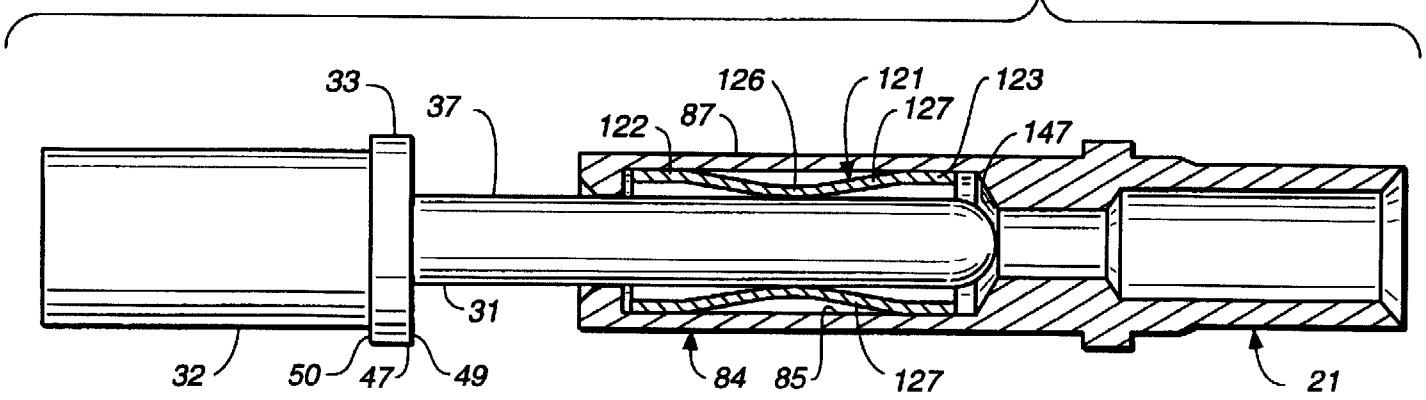
FIG. 7 is a partial sectional view of the pin contact of FIG. 6 completely inserted in the socket contact.

When pin contact 27 is fully engaged with socket contact 21 (i.e., pin 31 is disposed in hood 84), raised cross members or contacts 127 forming part of conductive element or strip 121 engage pin outer surface 37 (FIG. 7). Cross members 127 and outer surface 37 serve as the main electrical connection between socket and pin contacts 21 and 27 after the pin 31 has been fully inserted in hood 84. Tapered portion 147 is dimensioned and configured to receive the end portion of pin 31 should the pin extend that far within socket contact 21.

As can be seen, the unique and novel configuration of socket contact 21 precludes deleterious electrical arcing between pin contact 27 and thin conductive strip 121 mounted within socket contact 21. This is made possible by the narrowed opening 111 which causes a mandatory engagement and a resulting electrical connection between pin and socket contacts 27 and 21 before pin 31 can enter hood 84. The forcible interaction of pin end 38 and bevelled surface 100 causes opening 111 to radially expand and enlarge for allowing pin 31 to enter hood bore 85. Only after an electrical connection has been established between the socket and pin contacts, eliminating the arc producing electrical potential difference between the contacts, does pin 31 approach conductive strip 121.

The unique and novel configuration of socket contact 21 also provides a more electrically efficient contact than the prior art due to the continuous or integrally formed hood 84 and end portion 158. The integrally formed or continuous configuration eliminates a joint between the end portion (i.e., tail section) and the hood. Joints create resistance thus, with non-integrally formed hoods and tail sections, the current goes through the conductive element to the base of the hood and experiences resistance at the joint between the hood and the tail section. Then, choosing the path of least resistance, travels up the hood before returning and crossing over the joint. Whereas, with the present invention, the current passes from the conductive element to the hood, and not experiencing any resistance between the hood and tail section, travels easily into the tail section of the socket contact.

End portion 158 can have other generally known configurations for facilitating an electrical connection by an electrical source to socket contact 21 other than the crimp shown such as soldered, attached with a "pig tail", etc. and be within the scope of the present invention as one of ordinary skill in the art will recognize.

It is apparent from the foregoing that a new and improved socket contact for use with a pin contact has been provided with improved electrical efficiency and which prevents arcing damage of a conductive contact element mounted in the socket contact. The socket contact has an end provided with an opening smaller than the diameter of the contact pin for ensuring an electrical connection before the pin contact enters the socket contact. The opening is expandable to permit entry of the contact pin when forcibly inserted into the socket contact. The socket contact can be used with a variety of tail sections. While only certain presently preferred embodiments have been described in detail, as will be apparent to those familiar with the art, various variations, substitutions, changes, modifications and equivalents can be made without departing from the scope of the invention as defined by the following claims.

What is claimed is:

1. A socket contact for mating with a pin contact, said socket contact comprising:

an electrical component-attaching section integrally formed with a receptacle section, the receptacle section having a wall forming a bore for receiving the pin contact, the receptacle section having a conductive element in the bore having a contact portion for contacting the pin contact, an arc-arresting end portion having a thickness greater than the wall forming the bore and an opening therein which opens into the bore and has a diameter smaller than an outer diameter of the pin contact for initially engaging the pin contact and establishing an electrical connection between the pin contact and the socket contact whereby the mandatory engagement and resulting electrical connection between the pin contact and the arc-arresting end portion precludes deleterious electrical arcing between the pin contact and the conductive element, and expansion means for permitting the opening to expand as the pin passes therethrough into the bore.

2. The socket contact of claim 1 wherein the expansion means comprises at least one slot in the receptacle section.

3. The socket contact of claim 1 further comprising an electrical connector housing portion having a receptacle therein, the receptacle section of the socket contact being disposed in the receptacle.

4. The socket contact of claim 1 wherein the expansion means comprises a plurality of slots in the receptacle section.

5. The socket contact of claim 4 wherein the end portion has a bevelled surface extending radially outwardly and in a first direction for causing the opening therein to expand when the pin contact is inserted into the opening.

6. The socket contact of claim 1 wherein the conductive element comprises a strip of spring contacts of conductive material mounted substantially around an inner wall of the bore.

7. The socket contact of claim 6 wherein the strip comprises a plurality of spaced apart cross members with a segment along their length having a reduced width.

8. An electrical socket contact for mating with a pin contact in an electrical connector, said socket contact comprising:

an electrical component-attaching end;

an elastically expandable cylindrical section opposite of and integral with the electrical component-attaching end, the elastically expandable cylindrical section having an annular wall forming a cavity therethrough for receiving the pin contact, the elastically expandable cylindrical section having a portion with a thickness greater than the annular wall and being adjacent to an opening with a diameter smaller than an outer diameter of the pin contact whereby an electrical connection is initially made between the pin contact and the cylindrical section in an area adjacent to the opening when the pin contact is inserted through the opening into the cavity; and a strip of spring contacts of conductive material located in the cavity of the elastically expandable cylindrical section.

9. The socket contact of claim 8 wherein the elastically expandable cylindrical section comprises at least one extending along at least a portion of the length of the elastically expandable cylindrical section from the opening.

10. The socket contact of claim 8 wherein the elastically expandable cylindrical section comprises a plurality of slots extending along at least a portion of the length of the elastically expandable cylindrical section from the opening.

11. The socket contact of claim 8 wherein the strip comprises a plurality of spaced apart cross members with a segment along their length having a reduced width.

12. The socket contact of claim 8 further comprising an electrical connector housing portion having a receptacle therein, the elastically expandable cylindrical section being disposed in the receptacle.

* * * * *